United States Patent [19]

Skrzelowski

[11] Patent Number: 4,769,862

[45] Date of Patent: Sep. 13, 1988

[54] SHOWER CURTAIN SUPPORT

[75] Inventor: David S. Skrzelowski, Villa Hills, Ky.

[73] Assignee: Saturday Knight Ltd., Cincinnati, Ohio

[21] Appl. No.: 860,137

[22] Filed: May 6, 1986

[51] Int. Cl.[4] ..... A47K 3/22

[52] U.S. Cl. ..... 4/610; 4/605; 4/607; 4/608; 4/609

[58] Field of Search ..... 4/608, 610, 609, 607, 4/605

[56] References Cited

U.S. PATENT DOCUMENTS 2,219,075 10/1940 Veau ..... 4/610

2,923,013 2/1960 Wasserman ..... 4/610

4,088,174 5/1978 Edwards ..... 4/608

4,385,409 5/1983 File et al. ..... 4/610

*Primary Examiner*—Henry K. Artis

*Attorney, Agent, or Firm*—Wood, Herron & Evans

[57] ABSTRACT

A shower curtain support defines a track for slidably suspending a shower curtain across the front opening of a shower stall and around end corners of the support rearwardly at the front opening. End portions of the shower curtain may be drawn around the corners and inside the shower stall to overlap at least a portion of the surface of the stall end walls in order to prevent leaks. Alternately, a continuous curtain support track is provided in a U-shape or other configuration. End-pieces attached thereto support a curtain in a plane parallel to wall surfaces to prevent spraying or splashing outside the shower area.

9 Claims, 5 Drawing Sheets

SHOWER CURTAIN SUPPORT

FIELD OF THE INVENTION

The present invention relates to shower curtain supports. More particularly, the invention relates to a support for slidably suspending a shower curtain so that a portion of the shower curtain may be drawn around a shower stall or tub area to overlap at least a portion of the walls defining a shower area and prevent overspray or splashing outside the shower area.

BACKGROUND OF THE DISCLOSURE

It is common practice to suspend a waterproof shower curtain across a shower stall or bathtub opening or around a shower area to prevent shower water from splashing or otherwise spraying out onto the surrounding floor. Failure to confine water to the shower or tub stall necessitates mopping or otherwise drying wetted areas and can result in costly damage to floors, walls or other structures. Since both shower stalls and bathtub enclosures used as shower stalls present similar problems in this regard, as used herein and in the claims, the terms "shower stall" or "stall" mean any area adaptable for showering regardless of whether the same area may be used for other purposes such as bathing.

In a typical shower or tub stall defined by a rear wall, two end walls and an opening, a shower curtain is suspended from a straight member such as a rod which spans the shower stall opening. The curtain is usually hung from the rod by a plurality of hooks which slide along the rod to that the curtain may be drawn open or closed. A problem with this arrangement is that even when the curtain is drawn fully closed across the stall opening, the edge of the shower curtain does not butt closely against the end walls of the shower stall which extend at right angles to the opening. Gaps through which water can pass remain between the ends of the curtain and these wall surfaces of the shower stall.

To seal these gaps, persons often resort to wetting the surface of the shower stall in the area adjacent the gap and attempting to secure the shower curtain to the surface of the stall with water acting as a temporary adhesive agent. These efforts are not consistently successful. Depending on the nature of the shower stall wall surfaces and the shower curtain material, the curtain may not adhere at all, or may come loose quickly, requiring frequent attention. Children or others may forget to practice the procedure or intentionally decide to forego the inconvenience of it.

One way of addressing the problem of leakage from shower stalls is to outfit the shower stall opening with sliding or hinged shower doors. Unfortunately, such doors are relatively expensive. Also, installation generally requires more than one person and involves permanent or semi-permanent attachment of component parts to supporting structure. Accordingly, shower doors are often not practical for apartment dwellers, since they are relatively expensive, as compared to curtains and cannot be readily removed without structural damage.

Another attempt to deal with the leakage problem noted has been to provide an L-shaped bracket suspended by hooks from the end of a shower curtain rod so that one leg of the bracket runs below the rod while the other leg protrudes rearwardly into the interior of the stall. The end of the shower curtain is suspended from the protruding leg so that a flap or panel of the shower curtain protrudes into the shower stall. The curtain thus constantly hangs in a major plane with the leg portion extending from the plane into the stall. When the shower curtain is drawn closed, this panel hangs more or less parallel to the end wall surface of the shower stall to form an enclosure which is more water tight than one obtained by simply butting the edge of the shower curtain against the surface of the stall. This system is unsightly, however, since the panel protrudes into the stall even when the shower curtain is opened.

The splashing or overspray problem noted above is also applicable to shower areas of other configurations, such as where a free-standing tube or shower floor is disposed adjacent a single wall or in a corner defined by two walls, for example. In such configurations, the curtain surrounds the area on the open sides, but has ends terminated at the single wall or corner walls, for example.

Accordingly, it is an object of the invention to provide a shower curtain support from which a shower curtain may be suspended to provide good protection against leakage of water from the shower stall or area.

It is a further object of the invention to provide a shower curtain support which is relatively affordable, attractive and easy to install.

It is a further object of the invention to provide a shower curtain support from which a shower curtain may be suspended so that when the shower curtain is drawn closed, overspray and splashing outside the shower area is prevented.

SUMMARY OF THE INVENTION

To these ends, the present invention provides a novel, improved shower curtain support which is attractive, affordable, easy to install and operate and which provides enhanced protection against leakage.

According to one preferred embodiment of the invention, a shower curtain support is provided with at least one curved end which projects inwardly from the major extension of the support toward the rear of the shower stall. This end is constructed to define an operative continuation of the support so that an end portion of the shower curtain may be drawn both along the support inside the shower stall and suspended in a plane generally parallel to the end wall surfaces of the stall to prevent leaks.

The shower curtain support includes a track having captive fasteners mounted therein from which a shower curtain may be slidably suspended. The track extends throughout the major portion of the support and operably continues around the inwardly projecting portions of the support along an arcuate path. The shower curtain can be drawn easily and smoothly into position along the support and along the curved track to a position adjacent and in a plane parallel to the end wall surface of the shower stall. Upon opening, the shower curtain follows the track, sliding from the region inside the shower stall.

The preferred support is also adjustable to fit stall openings of various sizes. To this end, a straight portion of the support is cut to length by the consumer and then fitted preferably to two similar curved end portions which provide spring loaded abutment means for securing the support in place, and which define as well the curved continuation of the curtain support track as noted above.

In an alternate embodiment, the major support is comprised of straight and/or complimentary curved support sections, each defining a portion of an operable continuous track providing elongated slidable support means for a curtain to be drawn around the shower area. End pieces are attached to the major support at angles thereto and provide a continuation of the track so that the curtain can be drawn along and in a plane parallel to wall surfaces defining a portion of the shower area to prevent overspray and splashing.

BRIEF DESCRIPTION OF THE DRAWINGS

The invention will become even more readily apparent from the following detailed description of a preferred embodiment and from the drawings in which.

DESCRIPTION OF THE PREFERRED EMBODIMENT

Figure 1:
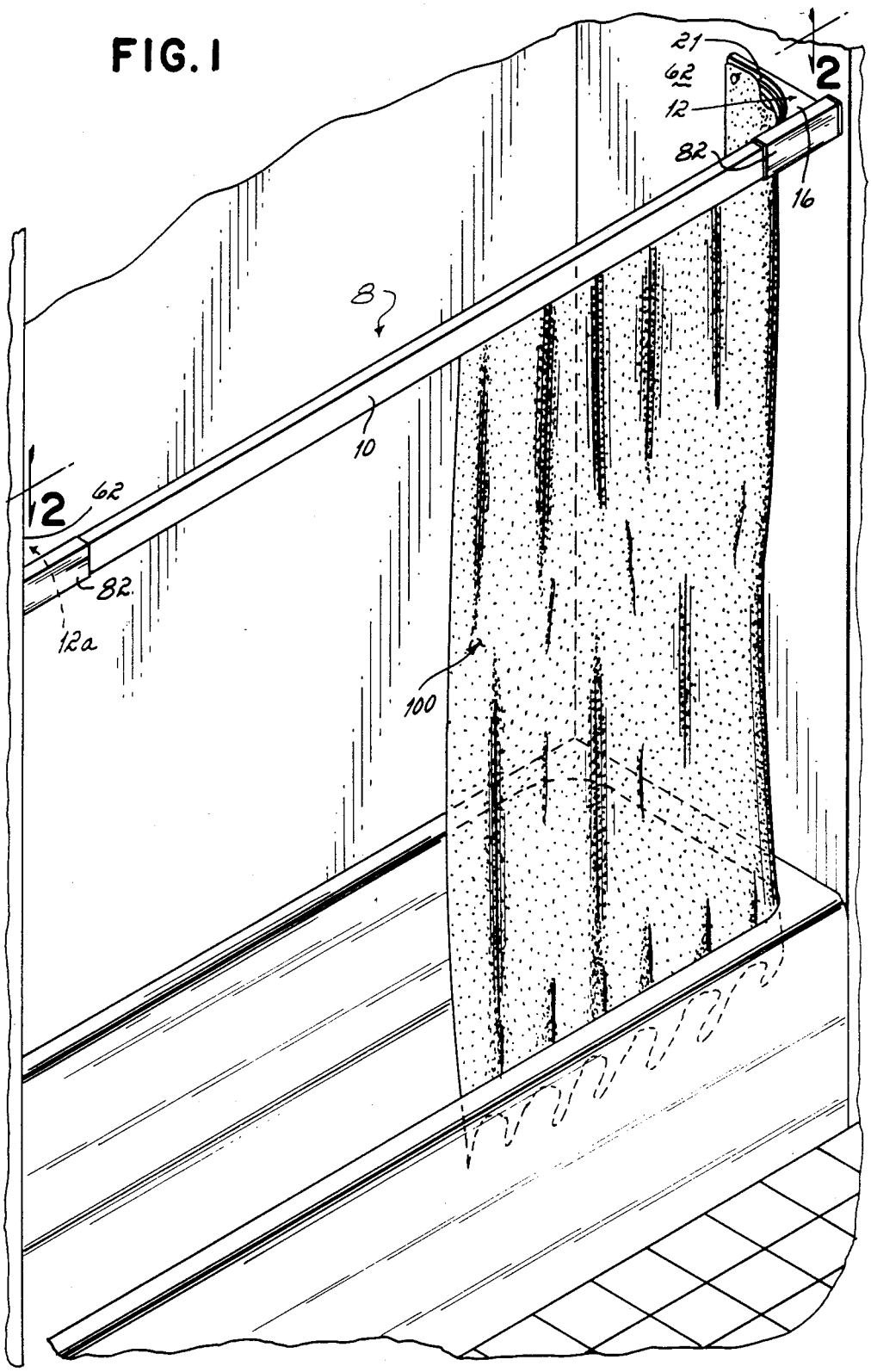
FIG. 1 is a partial perspective view of the preferred embodiment of the invention mounted in a shower stall and having a shower curtain mounted thereon.
Figure 2:
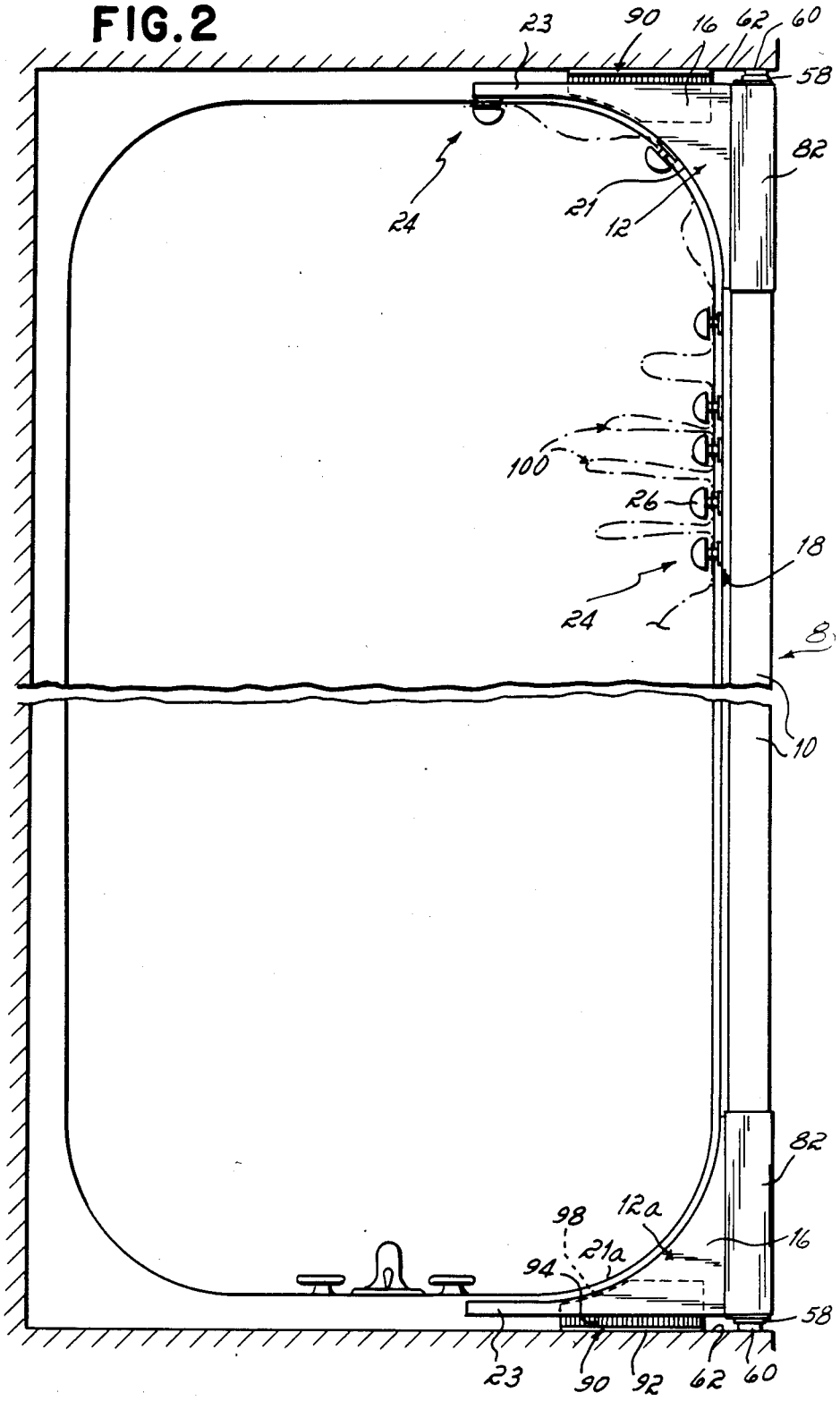
FIG. 2 is a plan view taken along line 2—2 of FIG. 1 showing the preferred embodiment of the invention mounted in a shower stall and having a shower curtain mounted thereon.

As shown in FIGS. 1 and 2, the shower curtain support 8 of the invention comprises a main bar 10 having an endpiece **12,12*a* connected to one or both ends thereof. The endpieces 12,12*a* may be identical or may be mirror images of each other. Each endpiece 12,12*a* includes a body portion 14 extending axially from main bar 10 and a projection 16 extending substantially perpendicularly from the body portion 14**.

Main bar 10 is provided with a curtain support means comprising a straight curtain support track 18 defined by upper and lower track lips 20 and 22 respectively. Each of the endpieces **12,12*a* also includes a curtain support means comprising curtain support track 21 and 21*a* respectively. The tracks 21 and 21*a* are preferably curved and when endpieces 12,12*a* are joined to the main bar 10, the tracks are operably connected to form a single curtain support track having an intermediate straight extension and two curved end portions as best seen in FIG. 2**.

A plurality of fasteners 24 are slidably disposed within the substantially continuous track 18 carried respectively by the main bar 10 and each endpiece **12,12*a*. As noted, track portions 21 and 21*a* carried by each end piece 12 and 12*a* follow an arcuate path to effect a 90° bend between the point at which they meet that portion of track 18 carried by main bar 10 and the end 23 of projection 16. A plurality of fasteners 24 are slidably disposed within track 18**.

Figure 7:
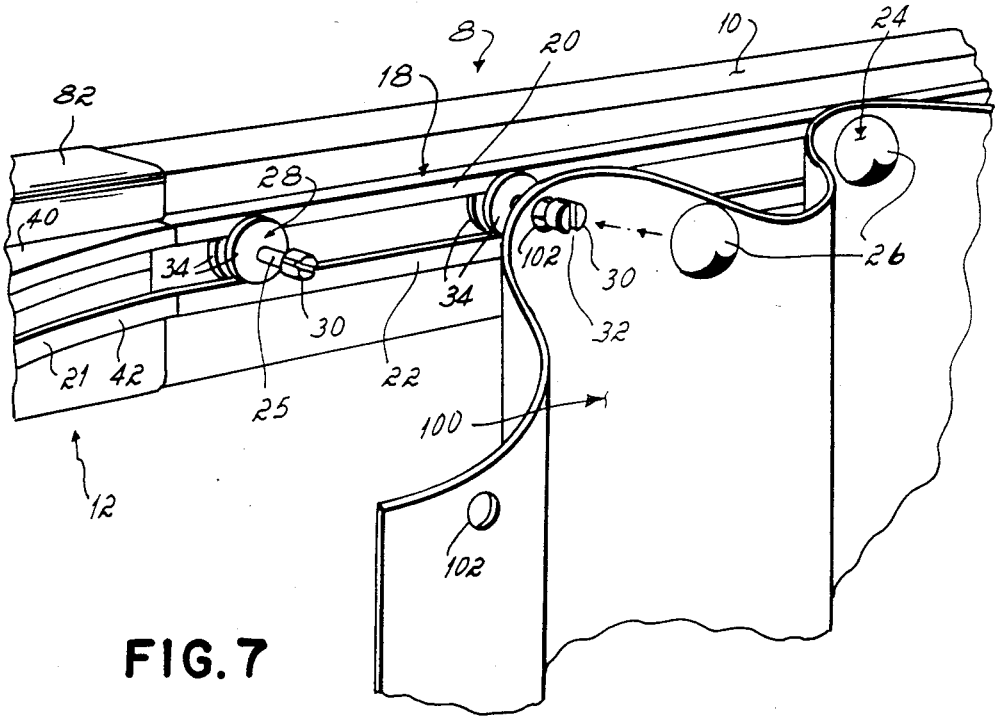
FIG. 7 is a partial, perspective view showing the attachment of a shower curtain to the preferred embodiment of the invention.
Figure 5:
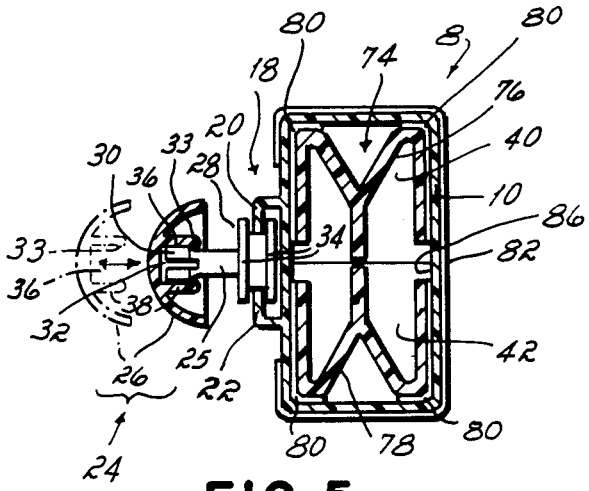
FIG. 5 is a cross-sectional view taken along line 5—5 in FIG. 4.

As best seen in FIGS. 5 and 7, each fastener 24 comprises a stud 25 and a cap 26 which is removably snap fitted thereto. Each stud 25 has a base 28 and a bifurcated head 30, split by a slot 32 to enhance its resiliency. The base 28 of stud 25 includes a pair of circular flanges 34 which retain the stud 25 within the "C"-shaped track 18. Cap 26 includes a recess 36 defined by a wall 38 having an inwardly projecting top rim 33 which grips the rear portion of the head 30 of stud 25 when cap 26 is attached to stud 25.

Figure 3:
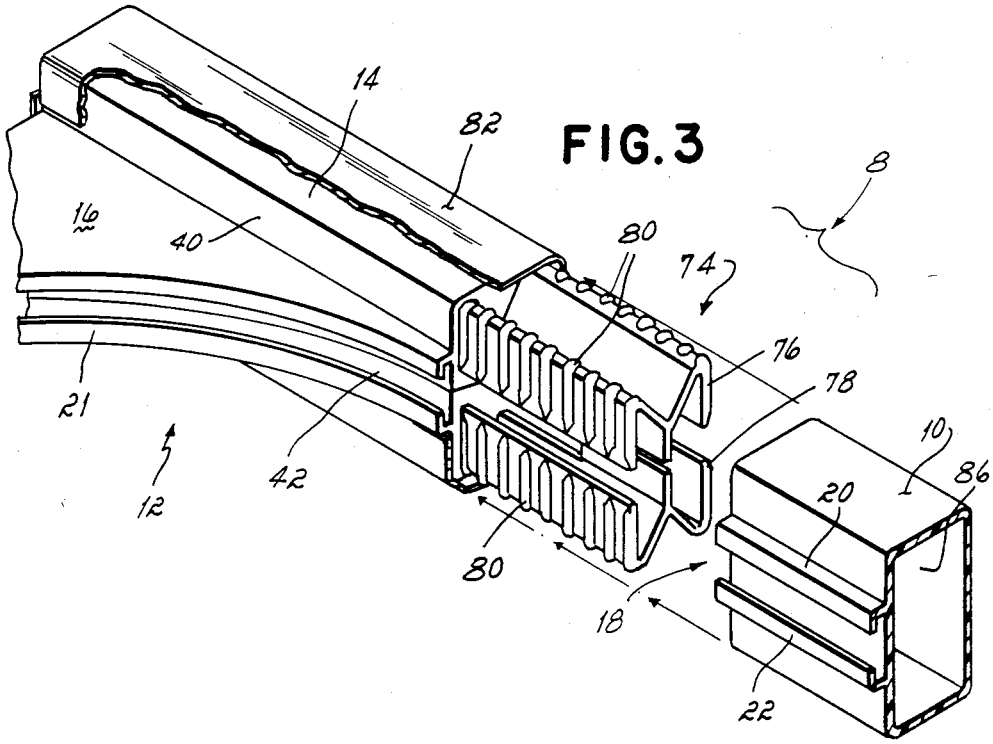
FIG. 3 is an exploded perspective view of the invention of FIG. 1 and showing the connection of an endpiece to the main bar.
Figure 4:
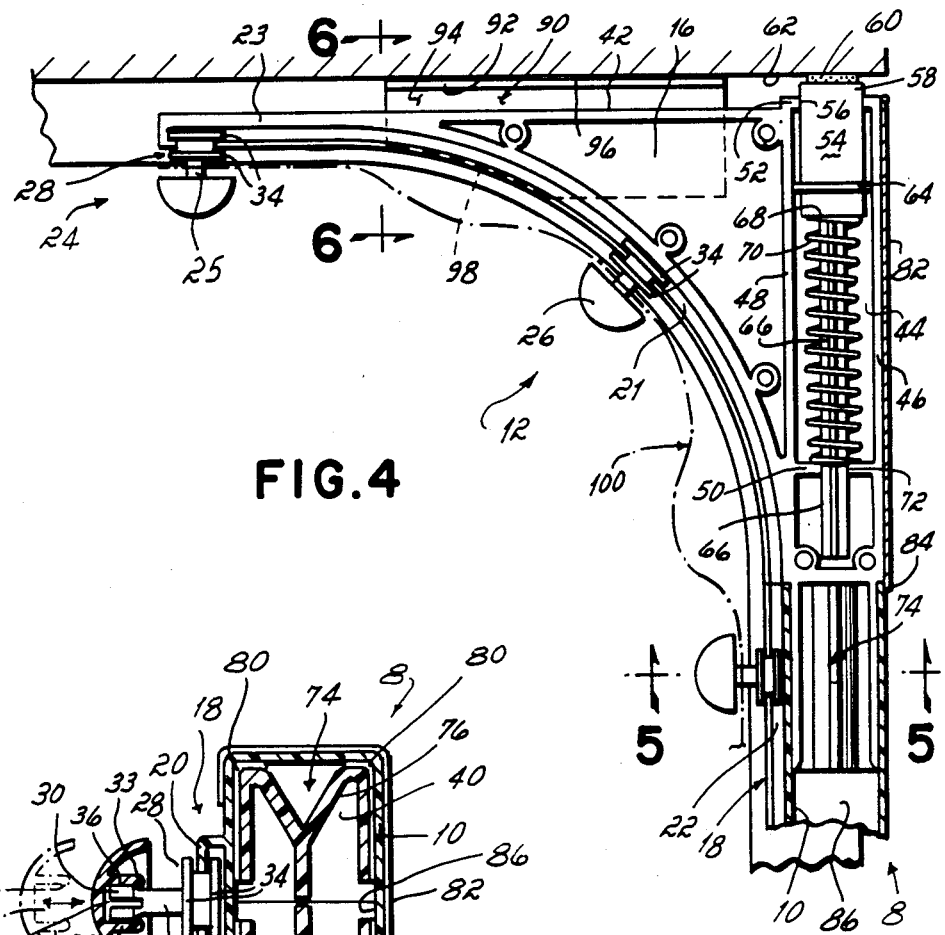
FIG. 4 is a top cross-sectional view of an endpiece according to the invention in mounted position at a stall end wall.

As best seen in FIGS. 3 and 4, each endpiece **12,12*a* is assembled from a lower housing 42 and a complementary mating upper housing 40, each of which may be injection molded of polymeric material. The body portion 14 of endpieces 12,12*a* includes a cavity 44 defined by opposed front and rear walls 46 and 48 respectively and opposed side walls 50,52. A spring-loaded mounting plunger 54 is slidably disposed partially within cavity 44. Side wall 52 includes an aperture 56 from which the end 58 of plunger 54 protrudes. The end 58 of plunger 54 includes a resilient pad 60 to avoid marring mounting surface 62 and to improve the grip of the shower curtain support 8 on mounting surface 62. Ears 64, extending from plunger 54, retain plunger 54 behind side wall 52 and also help to guide plunger 54 along front and rear walls 46 and 48. A shaft 66 extending from the opposite end 68 of plunger 54 passes through a compression spring 70 retained at each end by plunger 54 and side wall 50. When plunger 54 is forced inwardly, toward side wall 50, spring 70 tends to force plunger 54 outwardly away from side wall 50. Plunger 54 is further guided by shaft 66 which extends through an opening 72 in side wall 50 having a shape complementary to the cross-section of shaft 66** which is preferably a cruciform shape.

As best seen in FIGS. 3 and 5, the body portion 14 of endpiece **12,12*a* also includes a resilient mandrel 74 which is received within main bar 10 to operably connect endpiece 12,12*a* to main bar 10. Mandrel 70 comprises an upper half 76 and a lower half 78 which extend from upper housing 40 and lower housing 42 respectively. Both halves 76,78 are substantially "M"-shaped in cross section and mate as mirror images as shown. Each half 76,78 of mandrel 74 includes a plurality of ribs 80 which are sized for a slight interference fit within main bar 10. Each endpiece 12,12*a* is joined snugly to main bar 10 when mandrel 74 is received within main bar 10 due to the fit and resiliency of the compressible mandrel which is slightly compressed to resiliently hold the main bar 10**.

Upper housing 40 and lower housing 42 of endpiece **12,12*a* are held together, at least partially, by a trim strip 82 having a C-shaped cross-section. Trim strip 82 slips over the body portion 14 of endpiece 12,12*a* to keep upper and lower housings 40,42 together. Preferably, trim strip 82 is made of metal which may be plated, polished, painted or otherwise finished to provide an attractive appearance. Trim strip 82 should be sufficiently long to slightly overlap mandrel 74 as is best seen at 84 in FIG. 3. The overhanging portion 84 of trim strip 82 is located to conceal from view the joint between main bar 10 and endpiece 12, 12*a*** for reasons which will be explained below.

Main bar 10 is a tube structure having a hollow interior 86 and an integrally formed section of "C"-shaped track 18 located exteriorly and along the backside thereof. Preferably, main bar 10 is formed as an extrusion. While main bar 10 may be made of any suitable material such as aluminum, it is preferably made of polymeric material selected to provide a good appearance and low cost. The length of main bar 10 is selected to be a dimension large enough so that when assembled, shower curtain support 8 will fit the largest expected shower stall opening. Should the length supplied be too long, main bar 10 can easily be trimmed to length in the field by even the most inexperienced installer or consumer. In the event the cut made by the installer is somewhat uneven, it will be hidden from view by the overhanging portion 84 of trim strip 82 when the shower curtain support 8 is assembled.

The shower curtain support 8 is installed by trimming main bar 10 to length if required. Trim strip 82 is then slipped over the body portion 14 of each endpiece 12,12*a*, and the required number of studs 25 are slipped into track 18. Each endpiece 12, 12*a* is then connected to main bar 10 by inserting mandrel 70 of each endpiece 12, 12*a* inside the respective ends of main bar 10. This effectively connects the track 18 in main bar 10 with curved tracks 21 and 21*a* in the respective endpieces 12 and 12*a*. The shower curtain support 8 is then located at the desired height near the opening of a shower stall and oriented so that projection 16 of each endpiece 12, 12*a* extends a distance into and toward the rear of the shower stall. Shower curtain support 8 is then slipped into place between opposing walls by depressing plungers 54. When released, these plungers 54 hold shower curtain support 8 between opposing mounting wall surfaces 62 by virtue of the forces provided by springs 70.

Figure 6:
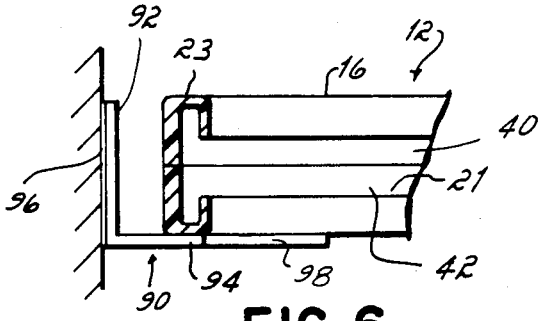
FIG. 6 is a cross-sectional view taken along line 6—6 in FIG. 4.

Due to the moment arm provided by the projection 16 of each endpiece 12,12*a*, a bracket 90 is provided to support projections 16, as is best seen in FIGS. 4 and 6, in order to prevent any downward movement, exerted by the curtain weight or the rearward projections 16, from pivoting main bar 10 about its longitudinal axis. Bracket 90 is preferably an L-shaped support having a vertical leg 92 and a horizontal leg 94. Vertical leg 92 is attached to the mounting surface 62 at the proper height by suitable fastening means such as an adhesive layer 96. The projection 16 of endpiece 12, 12*a* then rests upon the horizontal leg 94 of bracket 90 and is supported thereby. The horizontal leg 94 of bracket 90 may include a relieved area 98 so that the horizontal leg 94 of bracket 90 does not protrude beyond track 18.

As shown in FIG. 7, a shower curtain 100 may be suspended from shower curtain support 8 by passing the heads 30 of studs 25 through corresponding holes 102 located near the top edge of the shower curtain. The shower curtain is retained on each stud 25 by snapping a cap 26 over the head 30 of each stud 25, cap 26 being larger than each hole 102.

Figure 11:
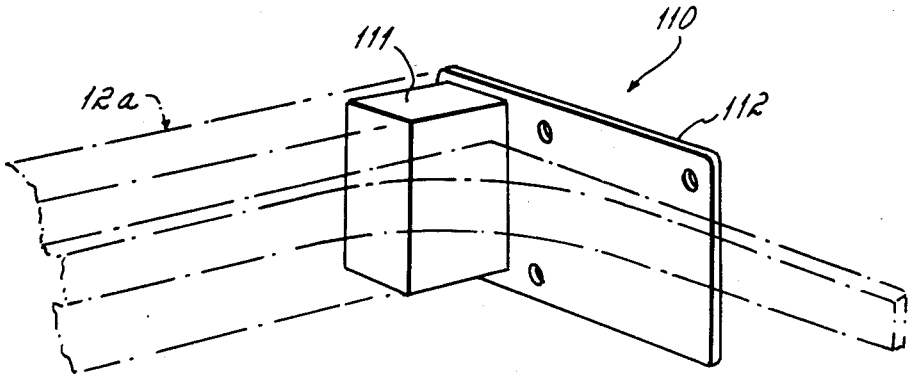
FIG. 11 illustrates a permanent end wall mount of the invention.

In operation, the shower curtain support 8 of the invention permits a shower curtain 100 to be slidably suspended across a shower stall opening so that when the shower curtain 100 is closed, end portions of the shower curtain slide around curved tracks 21 and 21*a* to a position inside the shower stall where they are dispersed in planes substantially parallel to the end walls of the stall. The curtain ends are suspended from the projection 16 of each endpiece 12, 12*a* substantially perpendicular to the opening of the shower stall and thus prevent shower water spray from leaking out through the shower stall opening. When the shower curtain 100 is opened from one end, it is drawn off the respective projection 16 and track 18 to a position where it hangs at the other end of the shower stall substantially below main bar 10. The opened end does not extend rearwardly into the tub or stall and thus does not interfere with opening or closing.

of course, the support described herein could be used with permanent wall mounting apparatus which would not require the spring-loaded bumper ends. For example, FIG. 11 illustrates a permanent wall mounting bracket 110 having a projection 111 for fitting into an endpiece 12, 12*a* (having the spring plunger 54 removed). Flanges 112 are secured to a wall (not shown) for permanent mounting of the rod and endpieces 12, 12*a*.

Figure 8:
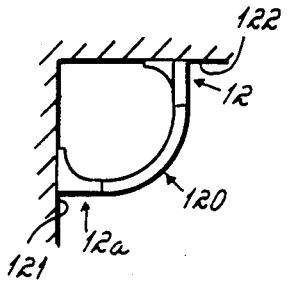
FIG. 8 is a top plan view illustrating a further embodiment of the invention.
Figure 10:
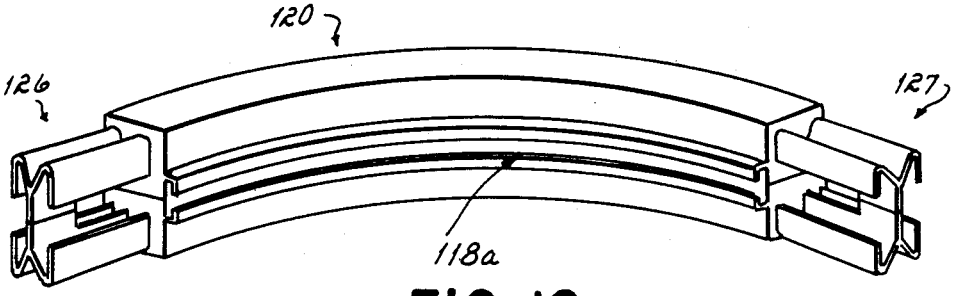
FIG. 10 is a perspective view illustrating a curved curtain support such as that utilized in the embodiments of FIGS. 8 and 9.

Also, the bar 10 could be molded in configurations other than as a straight bar. For example, a curved bar 120 in a 90° bend shape (FIGS. 8 and 10) could be used for a corner shower. Endpieces 12, 12*a* are secured to the ends of bar 120 to provide a continuous curtain track slidably mounting a curtain in a plane parallel to walls 121, 122, to prevent splashing. Such a curved bar 120 includes a continous track 118*a* for slidably receiving curtain support or fasteners 24 (not shown in FIG. 10). Ends of the track 118*a* are open for operative communication with similar tracks on adjoining endpieces 12, 12*a*, for example, or bars such as bar 10. Also, bar 120 is provided with resilient mandrels 126, 127 similar to mandrels 74 for receiving other bars 10 or 120 or endpieces 12, 12*a*.

Figure 9:
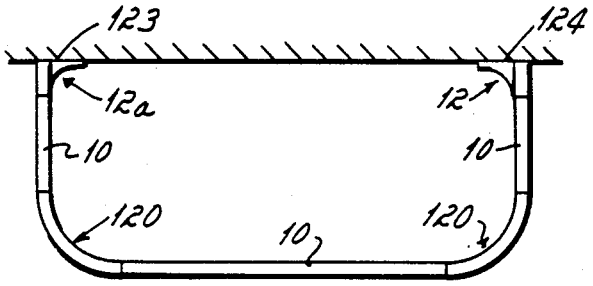
FIG. 9 is a top plan view illustrating another embodiment of the invention.

Alternately, a single bar or multiple bars 10 could be combined with two curved bars 120 to provide a main bar having curved portions and to provide a U-shaped, three-wall curtain partition around a tub disposed against a straight wall such that the tub has three sides exposed (FIG. 9). In this configuration, endpieces 12, 12*a* provide a continuous track for mounting curtain end portions in a plane parallel to wall areas 123, 124 to prevent splashing. In all these embodiments, the curtain is preferably disposed inside the tub or shower floor wall. Moreover, it should be appreciated that bars 10 and curved bars 120 can be provided in different lengths and curvatures to provide an improved curtain support to many varied varied types of bathing and showering areas.

Bar endpieces 12, 12*a* are used to provide continuous support for hanging the curtain in planes parallel to the walls adjacent the bathing installation where the 90° walls (corner) or the straight wall, for example, have portions comprising stall "end walls" adjacent the curtain ends and within the meaning of this application, thereby preventing splashing or spraying outside the bathing enclosure of even these other tub or stall configurations or mountings.

The present invention may, of course, be carried out in other specific ways than those set forth above without departing from the scope of the invention. The above embodiments are, therefore, to be considered as illustrative, and applicant intends to be limited only by the claims appended hereto.

I claim:

1. A shower curtain support for suspending a shower curtain across and into a shower stall opening defined in part by parallel end walls spaced apart a predetermined distance, said support including:

an elongated bar of a length shorter than said predetermined distance;

first curtain supporting track means extending along said bar;

a bar endpiece disposed on each end of said bar for mounting said bar between said end walls;

said endpieces each having an integral return portion extending in a direction substantially perpendicular to said bar for disposition substantially parallel to an end wall;

second curtain supporting track means on each endpiece operatively joined with said first curtain supporting track means and extending along said endpieces to a position along said return portion substantially perpendicular to said bar for providing a continuous substantially uninterrupted curtain supporting track for slidably supporting a curtain both parallel and perpendicualr to said bar with respective ends thereof parallel to respective ones of said end walls.

2. The shower curtain support of claim 1 further including a plurality of fasteners slidably disposed within the continuous, uninterrupted curtain supporting track for slidably suspending the shower curtain and wherein each of said fasteners comprises:

a stud, one end of said stud being slidably captured within said track and;

a cap adapted to be selectively attached to the other end of said stud to retain the shower curtain.

3. The shower curtain support of claim 1 wherein each said endpiece further comprises a spring-biased plunger directed toward a respective end wall for mounting said shower curtain support across said shower stall opening.

4. The shower curtain support of claim 1 wherein said bar includes at least one partially hollow end and each said endpiece includes a resilient mandrel adapted to be received within said end to connect said endpiece to said bar.

5. The shower curtain support of claim 4 further comprising: a trim section member carried by at least one of said endpiece and said bar, said trim section having an end extending over a portion of said mandrel and covering at least part of the end of said bar when said bar is connected to said bar end.

6. The shower curtain support of claim 1 further comprising: bracket means for supporting said bar endpieces on an end wall surfaces of said shower stall.

7. A shower curtain support for suspending a shower curtain around a shower area wherein curtain ends are disposed adjacent support mounting walls, said support comprising:

a bar, at least one bar endpiece extending substantially perpendicularly from said bar, curtain supporting means on said bar for slidably supporting a curtain to hang beneath said bar, said bar endpiece also having curtain support means for suspending at least an end portion of the shower curtain in a plane parallel to said adjacent support mounting wall so as to overlap at least a portion of the end wall.

8. A shower curtain support as in claim 7, wherein said bar is at least partially curved.

9. A shower curtain support for use in supporting a shower curtain about the periphery of a shower area with ends of the curtain disposed in return areas parallel to wall surfaces on which the support is mounted, said support comprising:

an elongated bar of predetermined length and having two ends, a respective endpiece for assembly to each end of said bar and for mounting respective ends of said bar on respective wall surfaces lying in planes intersecting the direction of elongation of said bar at its ends, each said endpiece having an integral first portion connectable to said bar and extending, when so connected, in the direction of elongation of the respective bar end, and an integral second portion extending in a direction substantially perpendicular to said direction of elongation of the respective bar end;

first curtain supporting track means on said bar for slidably supporting a curtain therealong, second curtain supporting track means on each said endpiece, said first curtain supporting track means on said bar and said second curtain supporting track means on each said endpiece being connectable together in operative communication to provide when so connected a continuous curtain track extending along said bar, with said first integral portion of said endpieces and said second integral portion of said endpieces defining a curtain return position at each end of a curtain to be hung therefrom, each said endpiece also including means for directly engaging a mounting wall to support an end of said bar therein and means for connecting said first portion thereof to an end of said bar.

* * * * *

UNITED STATES PATENT AND TRADEMARK OFFICE

CERTIFICATE OF CORRECTION

PATENT NO. : 4,769,862

DATED : September 13, 1988

INVENTOR(S) : David S. Skrzelowski

It is certified that error appears in the above-identified patent and that said Letters Patent is hereby corrected as shown below:

In Column 8, Line 48, "therein" should be --thereon--.

Signed and Sealed this

Seventh Day of March, 1989

*Attest:*

DONALD J. QUIGG

*Attesting Officer*

*Commissioner of Patents and Trademarks*